United States Patent [19]

Gunderson

[11] Patent Number: 4,871,425

[45] Date of Patent: Oct. 3, 1989

[54] FIXATION DEVICE

[75] Inventor: Harald Gunderson, Oslo, Norway

[73] Assignee: Alfsen & Gunderson A/S, Oslo, Norway

[21] Appl. No.: 158,272

[22] PCT Filed: Jun. 11, 1987

[86] PCT No.: PCT/NO87/00046

§ 371 Date: Feb. 16, 1988

§ 102(e) Date: Feb. 16, 1988

[87] PCT Pub. No.: WO87/07663

PCT Pub. Date: Dec. 17, 1987

[30] Foreign Application Priority Data

Jun. 16, 1986 [NO] Norway ..... 862395

[51] Int. Cl.[4] ..... F26B 17/10

[52] U.S. Cl. ..... 162/290; 34/16; 34/155; 34/156

[58] Field of Search ..... 162/290, 205, 301, 305, 162/306'307, 207; 34/155, 156, 16

[56] References Cited

U.S. PATENT DOCUMENTS

| | | | |
|---|---|---|---|
| 3,945,881 | 3/1976 | Speidel | 162/290 X |
| 4,085,522 | 4/1978 | Stroszynski | 34/155 X |
| 4,320,587 | 3/1982 | Vits | 34/156 |
| 4,467,537 | 8/1984 | Trötscher | 34/155 |
| 4,606,137 | 8/1986 | Whipple | 34/156 |
| 4,625,433 | 12/1986 | Giancola et al. | 34/160 X |

*Primary Examiner*—Peter Chin
*Assistant Examiner*—Thi Dang
*Attorney, Agent, or Firm*—Dressler, Goldsmith, Shore, Sutker & Milnamow

[57] ABSTRACT

Fixation device for permeable web materials, such as felts and wires for paper machines, where air at controlled temperature and pressure is pressed through the web from jets in at least one pressure chamber (12) on one side of the web, to at least one corresponding suction chamber (15) on the other side of the web, the device thereby comprising an upper structure (9) and a lower structure (10) between which the web is running during operation where a pressure chamber (16) with a corresponding suction chamber (13) being arranged in front of, and a pressure chamber (14) with a corresponding suction chamber (11) being arranged behind, at least one middle pressure chamber (12) with a corresponding suction chamber (15), each pressure chamber (12, 14, 16) being provided with two jets arranged in an acute angle to the web and towards each other, with one front jet (17, 19, 21) and one rear jet (18, 20, 22), thereby establishing and maintaining an overpressure between the jets and the web, jets arranged in opposed pressure chambers and adjacent each other thereby directing air passed each other in such a way that air from one pressure chamber substantially is prevented in penetrating into the adjacent suction chamber, and the upper and lower structures (9, 10) being provided with ducts (30, 31) for an air flow having a controlled temperature, thereby avoiding deformations of the upper structure (9) due to temperature influences from the heated air in the fixation process.

4 Claims, 2 Drawing Sheets

FIXATION DEVICE

The present invention is related to a fixation device for felts and wires for paper machines, according to the preamble of the claims.

Felts and wires for paper machines today are produced in widths up to 10 meter and constructed to withstand large strains of different types, such as high moisture content, large temperature, large pressure, tension forces in the longitudinal direction and influence from chemicals.

The felts and the wires, shaped as endless bands, are running at very hight speeds in the paper machines, in extreme cases up to 2000 meters per minute. It therefore is substantial that they are homogeneous both in the longitudinal as well as in the thermally stable direction to ensure operation without problems.

One of the processes involved in the production of all types of felts and wires today is the heat treatment at a temperature substantially higher than the highest temperature by which the products are used in the paper maschines. This heat treatment, the fixation, provides the felts and the wires with thermical stabile properties and desired stretching properties. Additionally the felts and the wires also are treated with chemical solutions hardening at specified temperatures.

To provide the felts and the wires with the desired properties it is important that the same maximum temperatures is achieved across the whole width during the fixation process. Furthermore it is desired to achieve the same temperature throughout the thickness of the felt and the wire, in other words in the upper and lower surfaces as well as in the middle.

During fixation, the felt and the wires, as endless bands, are stretched between two parallel rolls of which at least one is driven in such a way that the felts can be moved through the fixation zone which is arranged parallel to and between the axis of the rolls.

A normal heating method in the fixation process is blowing heated air against both sides at the felt. As stated above, it is very important, and necessary, to maintain the same air temperature across the whole width of the felt or the wire. It is, however, not sufficient that only the temperature of the blown air is the same across the width as pressure differences may occur in the fixation zone due to small differences in the high air velocity which is necessary to achieve a good heat transfer to the felt. Surrounding air very easily will be drawn into the process by induction, which means that the environmental air is drawn into the fixation zone itself and here mixed with the air having controlled temperature.

The main parameters influencing the result of the fixation process are the temperature of the air penetrating the felt, the amount of air penetrating, the velocity of the air through the felt and strongly influencing the afore-mentioned, the distance between the jets and the felt is of major importance, e.g. the distance must be uniform along the entire length of the jets. Influencing the distance between the jets and the felt during operation is the behaviour of the upper structure due to the heat influence, which across a length of 10 meters or even more, can lead to a not acceptable distance difference between the middle of the structure and the ends.

Any leakage of surrounding air into the fixation zone will lead to a temperature reduction, and especially local reductions thereby increasing the danger of undesired temperature variations across the surface of the felt. Such air leakage is reduced to a certain extent by the use of sealings at apertures where the felt and the wire is transferred into or out of the heating zone, but a complete elimination so far has been difficult to achieve in practical work. By the fixation device according to the present invention, however, this problem in the fixation process is avoided in such a way that leakage air from the environment is not effecting the conditions in the fixation zone.

This advantage is achieved by the fixation device according to the invention as defined by the features stated in the characterizing clauses of the claims.

DETAILED DESCRIPTION OF THE DRAWINGS

Figure 1:
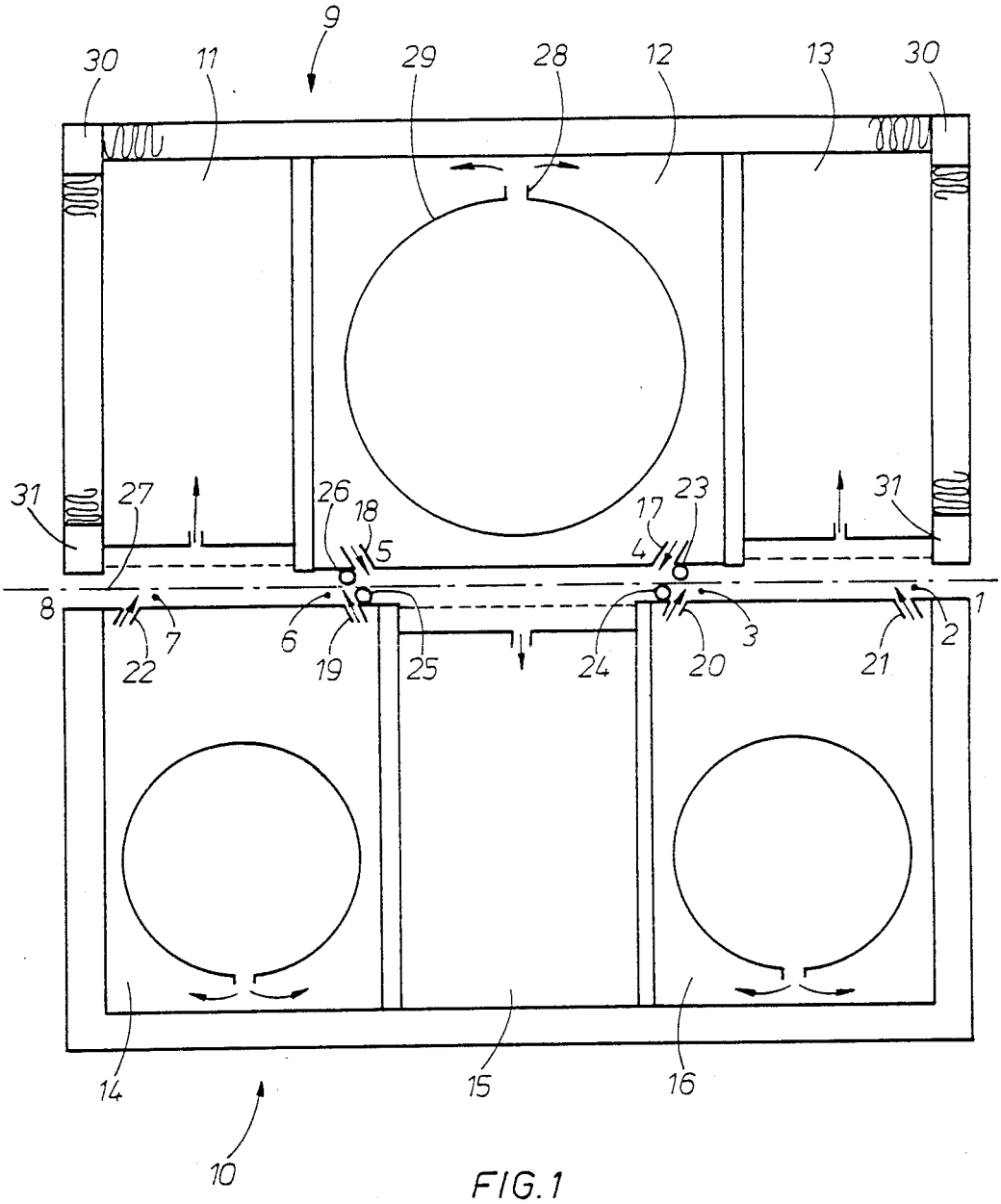
FIG. 1 discloses schematically a vertical section in longitudinal direction of the felt, of a fixation device according to the invention, and FIG. 2 and 3 disclose diagrams with the temperature of the felt in the longitudinal direction, of the upper surface of the felt, respectively in the middle of the felt.

FIG. 1 discloses the principal structure of a fixation device according to the invention, comprising an upper structure 9 and a lower structure 10 extending across the total width of the felt or the wire 27, perpendicularly to direction of movement of the felt. The felt as such creates an endless band, whereas only a short segment is disclosed in the Figure.

The upper structure 9 comprises a middle pressure chamber 12 supplied with pressurized air through a slit 28 in a duct 29, arranged in such a way that the air conditions as to temperature and pressure in the lower end of the pressure chamber 12 and especially across the full length of jets 5 and 17 arranged in the chamber, are substantially uniform.

The upper structure 9 is arranged in a distance from the lower structure 10, whereby the felt or the wire 27 is transfered between the structures. A middle suction chamber being arranged in the lower structure 10 is adapted to receive the pressurized air from the middle pressure chamber 12 in the upper structure after the air having passed through the felt 27. From the suction chamber 15 the air is brought to the devices adapted for conditioning of the air before reentrance into the pressure chamber 12, when using a closed circuit system.

In the lower structure 10, one pressure chamber is arranged on each side of the middle suction chamber 15, a front pressure chambers 16 and a rear pressure chamber 14. The pressure chambers 14 and 16 are supplied with pressurized air principally in the same manner as the pressure chamber 12, in such a way that the pressure conditions in the upper parts of the pressure chambers 14 and 16 being substantially uniform when entering first and second jets 19 and 22 in the pressure chamber 14 and first and second jets 21 and 20 in the pressure chamber 16.

Front and rear suction chambers 13 and 11 are arranged in the upper structure 9 opposed to the lower pressure chambers on each side of the middle pressure chamber 12. From the suction chambers 11 and 13 the air is guided to devices for reintroduction into the pressure chambers 14 and 16, separately or independently when using a closed circuit system.

The front jet 17 in the middle pressure chamber 12 is arranged on the inside, e.g., towards the middle of the fixation device as such, of the second jet 20 in the lower pressure chamber 16 in such a way that substantially all air from the jet 17 pressed through the felt and into the middle suction chamber 15 whereas the air from the jet 20 in the lower pressure chamber 16 passed into the front suction chamber 13.

All jets of the pressure chambers are arranged substantially in the front or rear part of the chambers and directed in an acute angle in relation to each other and to the web in such a way that the air from the jets is building up an overpressure between the jets and the felt and pressed through the felt into the opposed suction chamber. In this way the jets 20 and 21 of the front pressure chamber 16 in the lower structure are directing the air into the opposed suction chamber 13 in the upper structure, the jets 17 and 18 in the middle pressure chamber 12 are directing the air into the opposed middle suction chamber 15 and the jets 19 and 22 of the rear pressure chamber 14 are directing the air into the opposed suction chamber 11 in the upper structure 9.

For furthermore to avoid the air coming from the rear jet 20 of the front pressure chamber 16 and from the front jet 19 of the rear pressure chamber 14 in penetrating through the felt into the middle suction chamber 15, a bar 23 is extending across the entire length of the structure arranged in front of the jet 17 thereby substantially closing the gap between the felt and the structure without touching the felt to thereby avoid destruction of the felt surface. The air from the jet 20 thereby is guided on the outside of the bar 23, respectively the air from the jet 19 being guided on the outside of a bar 26 arranged behind the jet 18. Correspondingly, by means of a bar 24 inside the jet 20, and a bar 25 inside the jet 19, air from jets 17 and 18 is guided on the inside of the bars 24 and 25, thereby additionally contributing to avoid air from the front and rear pressure chambers to be brought into the middle air system. The bars 23–26 have such a form and are such arranged that they do not or just even touch the felt and substantially close the distance between the felt and the upper, respectively the lower structure 9 and 10.

During operation the environmental air necessarily is sucked in together with the felt 27 through the apertures between upper and lower structures 9 and 10, at both their front and rear portions. This environmental air will be taken up by the suction chambers 11 and 13 together with air from the suction chambers 11 and 13 and therefore will not influence the heat treatment of the felt or the wire.

As disclosed in FIG. 1, the upper structure 9 is provided with a support structure having closed channels 30 in the upper portion and corresponding closed channels 31 in the lower portion. The upper structure naturally also can be provided with further channels for the same purpose. The channels 30, 31 are used for air flow having a controlled temperature thereby securing that the upper structure 9 is not being deformed by influence of the heat from the fixation operation. This feature is essential especially for upper structures 9 having a relatively small height and bridging a rather long distance across the felt. The air through the channels 30 and 31 may be taken from one of the pressure chambers or from an auxiliary device.

By providing a separate circuit for the air between the middle chambers and a further circuit for the air in the outer chambers, possibly separate circuits even for the two outer chambers, a uniform treatment of the felt is ensured during fixation and thereby a homogeneous felt. Control of such circuits may be computerized by a computer device.

Figure 2:
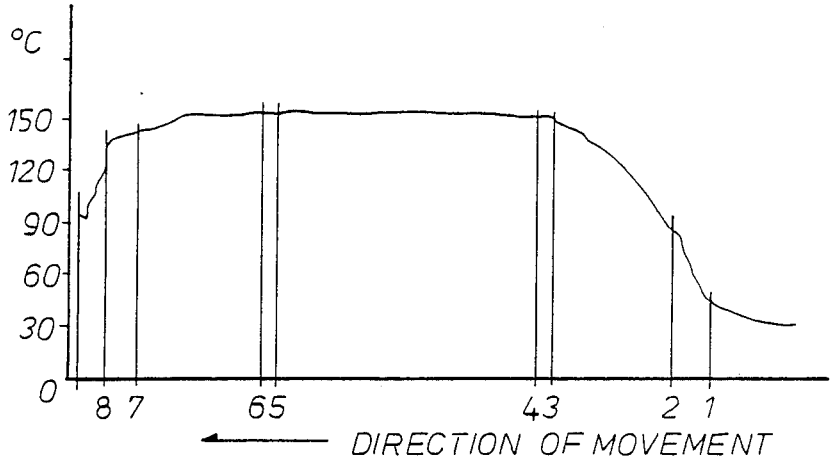
Figure 3:
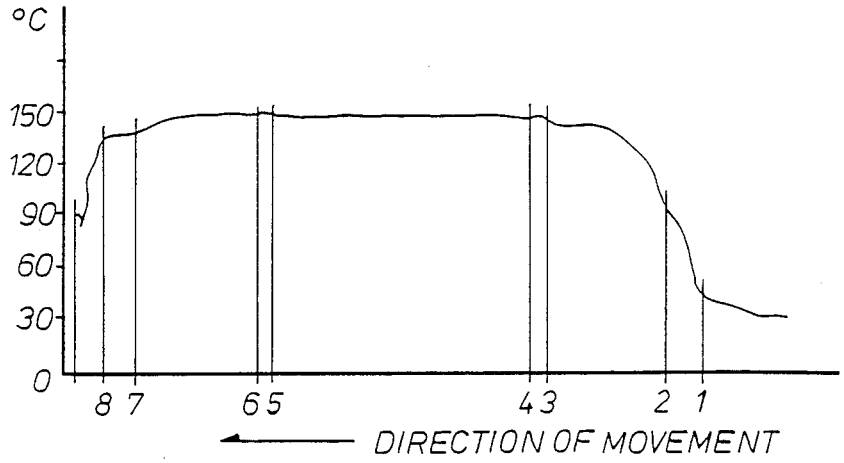

Tests have been performed with measurement of the temperature in the internal parts of the felt and on the surface of the felt at measuring points 1–8 as disclosed in FIG. 1. The measured values from those tests are disclosed in diagrams FIG. 2 and 3. Nominal temperature of the air was 150° C. and the resting time of the felt in the treatment zone was approximately 2 minutes and 15 seconds. The weight of the felt used was 1.03 kilo per $m^2$ and the permeability of the felt was 40 meter per minute at 250 Pa.

As disclosed in the diagrams 2 and 3, a very homogeneous temperature curve was achieved between the measuring points 4 and 6 and the temperature curves in this area approximately are the same on the upper surface of the felt as in the middle of the felt.

I claim:

1. Fixation device for permeable web materials, where air at controlled temperature and pressure is passed through the web from jets in at least one pressure chamber on one side of the web, to at least one corresponding suction chamber on the other side of the web, the device comprising an upper housing on one side of a web and a lower housing positioned below said upper housing and spaced therefrom on the other side of the web, whereby said web moves from an upstream position to a downstream position between said housings, during operation, the housings including means defining an upstream pressure chamber and means defining a corresponding upstream suction chamber located on an opposite side of a web, means defining a downstream pressure chamber and means defining a corresponding downstream suction chamber located on an opposite side of the web, and means defining at least one middle pressure chamber and means defining a corresponding middle suction chamber positioned between said upstream and downstream pressure chambers and corresponding suction chambers so that no two pressure chambers or suction chambers are next to each other, each pressure chamber being positioned with two jets arranged in an acute angle to the web and towards each other, with one upstream jet and one downstream jet, thereby establishing and maintaining an overpressure between the jets and the web, the jets arranged in the pressure chambers respectively in said upper and lower housing and adjacent each other thereby directing air past each other in such a way that air from one pressure chamber substantially is prevented from penetrating into the adjacent suction chamber, and ducts in the upper housing constructed and arranged to receive an air flow having a controlled temperature, at which deformations of the upper housing due to temperature influences from the heated air in the fixation process are prevented, and further including sealing devices extending across the length of the pressure chambers between the web and the pressure chambers, on both sides of each pressure chamber and arranged between the jets of the pressure chambers and adjacent suction chambers, thereby preventing air from the upstream or downstream pressure and suction chambers from penetrating into the air system of the middle pressure and suction chamber.

2. Device according to claim 1 including a control means operatively associated with said pressure chambers and suction chambers whereby the pressure and temperature of the air from one pressure chamber to a corresponding suction chamber is independently controllable from the air flow in other pressure chambers and suction chambers.

3. Device according to claim 1 or 2 including a central computer means operatively associated with the fixation device whereby the parameters for the air transferred from the individual pressure chambers to the respective suction chambers, as well as the moving speed of the felt are centrally controllable.

4. Device according to claim 1 or 2 including an air conduit in each pressure chamber extending along the entire length of the pressure chamber and having an outlet for air arranged opposed to the jets in its respective pressure chamber, in such a way that the air entering the jets has uniform temperature and pressure along the entire length of the jets.

* * * * *